US006983492B1

(12) United States Patent
Larson

(10) Patent No.: US 6,983,492 B1
(45) Date of Patent: Jan. 10, 2006

(54) TOILET SEAT REPOSITIONING HANDLE

(76) Inventor: Dean Richard Larson, 423 Morningview Ave., Akron, OH (US) 44305-2916

( * ) Notice: Subject to any disclaimer, the term of this patent is extended or adjusted under 35 U.S.C. 154(b) by 11 days.

(21) Appl. No.: 10/920,686

(22) Filed: Aug. 18, 2004

Related U.S. Application Data

(60) Provisional application No. 60/496,823, filed on Aug. 21, 2003.

(51) Int. Cl.
*A47K 13/10* (2006.01)

(52) U.S. Cl. ..... 4/246.1

(58) Field of Classification Search ..... 4/246.1–246.5
See application file for complete search history.

(56) References Cited

U.S. PATENT DOCUMENTS

| | | | | |
|---|---|---|---|---|
| 5,065,460 | A * | 11/1991 | Currin | 4/229 |
| 5,341,519 | A * | 8/1994 | Cusenza | 4/246.1 |
| 5,375,267 | A * | 12/1994 | Davis | 4/246.1 |
| 5,619,758 | A * | 4/1997 | Burkett | 4/246.1 |
| 5,727,258 | A * | 3/1998 | Derouin | 4/246.1 |
| 5,729,839 | A * | 3/1998 | Bigelow | 4/246.1 |
| 6,415,454 | B1 * | 7/2002 | Pierson | 4/246.1 |

* cited by examiner

*Primary Examiner*—Justine R. Yu
*Assistant Examiner*—Huyen Le

(57) ABSTRACT

A toilet seat repositioning device which is comprised of a handle flexibly attached to the toilet seat by various means and which extends beyond the periphery of said seat to provide relief from contact with the underside of said seat and/or bowl rim when repositioning of the toilet seat occurs. Restrictive features are utilized to constrain flexibility allowing handle to be load bearing.

10 Claims, 3 Drawing Sheets

TOILET SEAT REPOSITIONING HANDLE

CROSS-REFERENCE TO RELATED APPLICATIONS

This application claims the benefit of Provisional Patent Application Ser. No. 60/496,823 filed Aug. 21, 2003.

FEDERALLY SPONSORED RESEARCH

Not Applicable

SEQUENCE LISTING OR PROGRAM

Not Applicable

BACKGROUND OF THE INVENTION

1. Field of Invention

This invention relates to devices designed to assist in repositioning toilet seats.

2. Background of the Invention

This invention category deals with the historically repugnant action of having to reposition the seat of a toilet from down to up or vice versa. Over many decades patents have been sought for a wide variety of devices seeking to create relief from the distressing manual contact with the surface of the seat and/or bowl that occurs when repositioning takes place. We will herein exclude discussion of the preposterously complex apparatuses of levers and pedals and pulleys and cables and cams and gears and explore, instead, some attempts at simple solutions that, in a thorough examination, have inherent, glaring shortcomings.

Way back in 1935 G. F. Adams envisioned and designed an esthetically pleasing 'metal stamping'. Today, with the proliferation of both vandalism and injury lawsuits, use of such a device would be disasterous. (U.S. Pat. No. 1,999,555).

Charles C. Sims (1991, U.S. Pat. No. 5,058,215) patented a 'rigid planar Y-shaped member' that would adhesively attach to the underside of the seat with the upper part of the 'Y' straddling one of the bumpers and the lower part of the 'Y' extending beyond the peripheral edge of the seat. It would seem that this design, too, would invite lawsuits and vandalous destruction.

There is a variety of concepts of what could be called plate-like protuberances that attach to the bottom of the seat and extend beyond the outer edge.

The Mantooth (U.S. Pat. No. 3,717,884) idea is an oval plate with an outer ridge to aid in gripping; flexibility is not addressed. The Giallourakis disk (U.S. Pat. No. 4,742,582) and the later Giallourakis loop (U.S. Pat. No. 4,920,586) are both 'thin, rigid member's. Gibson and McNutt (U.S. Pat. No. 4,850,062) foresaw the need to 'substantially reduce the likelihood of abrasive contact with the skin' by designing a rotating wheel to attach to the bottom of the seat. Herein we have, seemingly, some relief from possible injury, a modicum of prevention of damage from vandalism, but virtually no relief from contact with the vile soiling of the underside of the seat as the majority of the disc is under the seat and subject to contamination from the aerosol action of flushing. Its rotation merely allows for the delivery of foulness to the hand of the user. A Hazard patent (U.S. Pat. No. 5,553,332) was for a round disk projection that 'is flexible so that upon coming into contact with the leg of a person when using the seat, the handle portion yields to the contact.' Introspection of this embodiment yields at least 3 shortcomings: First, due to the large horizontal cross-section, this device will need to twist to flex when lateral force is applied thereby abrading the 'leg of a person'. Secondly, due to its thin 'planar surface' it would require a firm grip to lift a heavy seat; especially since the handle is designed to flex in the direction of lift. This would probably exclude use by women or children. Compound this difficulty with the accumulation of oils on the surface of the handle from the hands of users and loss of grasp of even the strongest grip would seem likely and, potentially, very dangerous. Thirdly, when the toilet seat is in the vertical position and needs to be lowered it would seem to be immensely difficult for a person of short stature to reach and grasp the handle using either the thumb on top method or a thumb on bottom method.

Hazard had previously prescribe a solution to our dilemma under U.S. Pat. No. 4,875,251 wherein a simple cylindrical handle provided adequate relief from contact with the seat. The Preferred Embodiment is characterized as having 'some degree of resilience' but yet 'rigid'. If mounted with the suggested screw fastener the design would appear to have the inherent ability to swing away horizontally (in the seat down position) from contact. However, this is neither mentioned as a feature nor, apparently, envisioned as it is stated that the means of attachment should be an adhesive 'preferrably'.

Vincent P. Cusenza (U.S. Pat. No. 5,341,519) aptly described the solution as a 'flexible handle which is connected to the toilet seat in such a way that the toilet seat may be lifted without requiring a person to come in contact with the toilet seat itself and is also constructed in such a way as to provide a more durable lift handle which even if subjected to abuse will not break off and therefore provide long term life.' This successful synopsis of a solution did not seemingly assist in a successful solution. This patent is for a spring loaded flexible tube that requires boring a hole through the toilet seat from its outer circumference to its inner circumference and inserting the tube. This would seem to be a very difficult and very impractical endeavor.

OBJECTS AND ADVANTAGES

It was my objective in creating my device that numerous criteria be met:

1) It must provide total relief from contact with the toilet seat and/or bowl rim.
2) It must function well and with ease in the repositioning of the toilet seat.
3) It must have enough flexibility to reduce or eliminate injury from accidental contact by a person.
4) It must have enough resiliency to nullify damage to itself and/or the toilet seat from intentional contact by a person (vandalism, etc.).
5) It must be easilly afixed to the seat.
6) It must be attachable and functional on virtually any toilet seat.

Accordingly, the handle of my invention extends well beyond the periphery of the seat and is of an hourglass configuration; greater circumferences at either end than in the middle. This allows the user to merely hook a finger or two around the handle to conduct the repositioning instead of having to effect a strong grasp. The shape offsets forces that would cause the manual contact from slipping off one end of the handle or the other. Preferably constructed of a semi-flexible plastic in one piece (although it could be constructed from individual components), and attached to the toilet seat using a double-sided foam adhesive tape this invention would be very easily fitted to the seat by virtually anyone. The thin flexible mounting surface could conform to contours present on the underside of some toilet seats. Extending from the planar mounting surface is a flange or wall to which the handle shaft is attached. On the opposite side of this wall is a snubbing protuberance. This assures contact of this wall to virtually any type of toilet seat whether it be very thin, thick with a vertical outer radius wall or thick with an outer seat wall that is slanted. Contact between the flange and the seat stiffens the flange and supports it while under load. Although contact is not necessary, it is preferred to assure optimal functioning. This feature makes this device adaptable to virtually any seat.

However the salient feature of my invention is its ability to exhibit stiffness in an aspect necessary to engage a loading and to exhibit flex in other aspects to thwart injury or vandalism to the device and/or seat of the toilet. This was accomplished by creating restrictive features in the device that impede the motion of flexing in desired directions while allowing freedom of motion in others. Specifically, when the seat is in the horizontal or down position the handle and shaft are allowed to flex or move in either horizontal direction or any downward direction.

This device not only meets the need for relief from the distressing contact with a toilet bowl or seat when repositioning but does so via a simple retrofitting on virtually any seat and with an inherent measure of safety and resistence to intentional damage never before envisioned or accomplished. This provides the potential for use in situations never before possible (public buildings, restaurants, hospitals, schools, et al.) where the presence of such a device would be most welcome. Of course, this makes it ideal for domestic use, as well.

Further objects and advantages of my invention will become apparent from an examination of the drawings and ensuing descriptions.

SUMMARY

I am requesting a utility patent for a toilet seat repositioning handle of my unique design which allows movement of the handle portion in a direction(s) while restricting movement in another specified direction(s) via contact with a detent(s) whether intrinsic or external. The unique handle configuration (narrower in the middle circumference than at one or both ends) allows for secure manipulation.

DRAWINGS

Figure 1A:
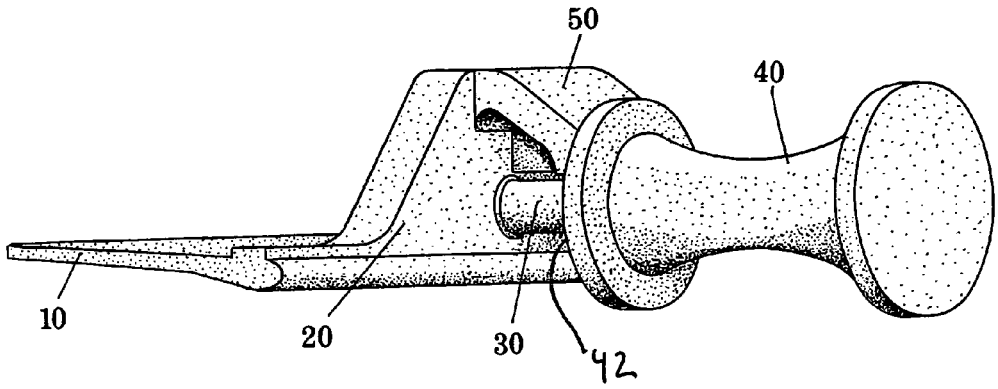
FIG. 1A shows a perspective view, detached

| REFERENCE NUMERALS | |
|---|---|
| 10 - mounting surface | 70 - adhesive |
| 20 - flange | 100 - toilet seat (cross section) |
| 30 - shaft | 110 - seat bumper pad |
| 40 - handle | |
| 50 - buttress | |
| 60 - detent | |

DETAILED DESCRIPTION

Figure 1B:
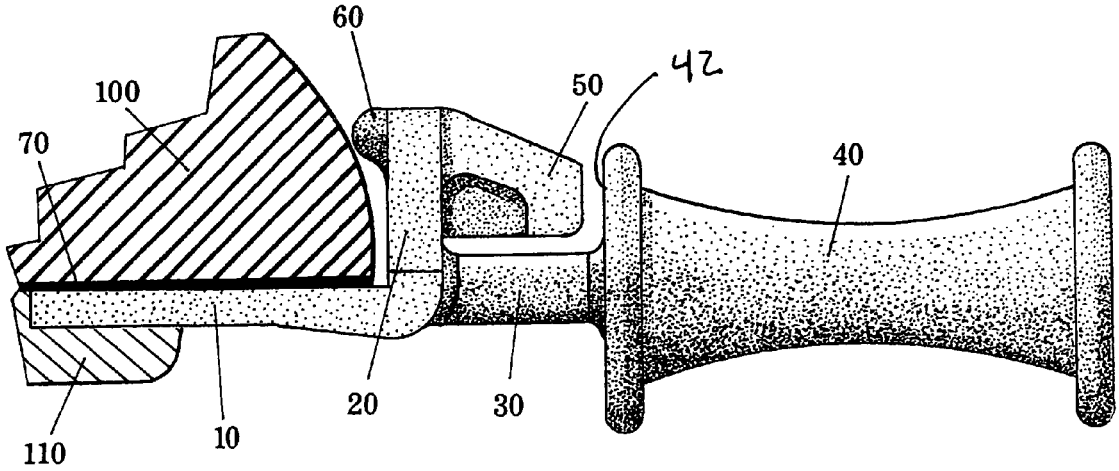
FIG. 1B shows a side view as attached to a toilet seat

Preferred Embodiment—FIG. 1B

To assist your comprehension of this description it should be pointed out that FIG. 1A is only minorly different than Embodiment 1B (note the presence of a reinforcing shoulder at the outside angle of the conjunction of the mounting surface 10 and the flange 20) on FIG. 1A).

In its Preferred Embodiment, my device has a planar mounting surface 10 for securing it to the bottom surface of a toilet seat via adhesive or mechanical fastener. Conjoined to said mounting surface 10 at or near an edge is a flange 20 which extends at an angle approximately perpendicular. From said flange 20 extends a shaft 30 at an approximately perpendicular angle. At the end of the shaft 30 is a handle 40. The handle 40 configuration can best be described as hourglass shaped; cylindrical with a taper from each end toward the middle so that the circumference at the midpoint is smaller than at either end. From above said shaft 30 location on the flange 20 is a buttress 50 which extends from the flange 20 to a juxtaposed position to the contact end 42 of the handle 40 that is closest to the flange 20. The aspect of the flange 20 facing the toilet seat 100 has a detent 60 protuberance of a hemispherical shape.

OPERATION OF INVENTION

In its Preferred Embodiment this device is to be molded of a mildly flexible plastic material. It is important to understand that plastics of a specific flexibility coefficient will exhibit more flexibility in a thin dimension than in a thick dimension; and conversely. This invention utilizes this characteristic of plastics to enhance flexibility in certain areas by using small dimensions and diminishing flexibility in other areas by using thicker dimensions and further diminishing flexibility and movement by borrowing rigidity from adjacent surfaces.

A relatively thin mounting surface 10 is utilized so that it may conform with non-planar surfaces on the underside of some toilet seats when adhesively attached using a foam double-stick tape. Said mounting surface 10 will gain rigidity from the surface to which it is attached thereby providing a secure mount. The flange 20 is designed to connect the handle shaft 30 and buttress 50 to the mounting surface 10 in secure manner. It is therefore molded more thickly and the area of contiguity is reinforced via a thickening radius or shoulder on the outside angle to provide strength. The aspect of the flange 20 facing away from the shaft 30 and buttress 50 and toward the toilet seat 100 has a protruding detent 60 of a hemispherical shape or elongated to a hemiprolate shape. It is the purpose of this detent 60 to contact the peripheral edge of the toilet seat 100 and annul any reactive motion of the flange 20 due to an upward loading of the handle 40 and shaft 30 that would be transferred to the buttress 50. If, due to a peculiar shape of the toilet seat, the detent 60 does not contact the toilet seat 100 support from the seat may still transfer to the flange 20. If not this device is still designed to function but with a slight deflection due to loading of the flange 20 and therefore also the shaft 30 and handle 40.

The handle 40 has been specifically designed to provide a secure connection between the user and the device even during deflection. This was accomplished by creating larger diameter plate-like flanges on the ends of the smaller diameter cylindrical central portion of the handle 40 and adding a generous chamfer at their conjoining.

With this device secured to the bottom of the toilet seat on a side and toward the front (approximately 4 o'clock or 8 o'clock positions when facing the toilet seat) and with the seat in the horizontal position the user would merely loop a finger or fingers around the handle 40 and apply a lifting force. The handle 40 of this device FIG. 1A is designed to flex approximately 30 degrees to reduce/eliminate injury from accidental contact and thwart damage to itself or the toilet seat from intentional contact. Therefore, under lifting load the shaft 30 and handle 40 will begin to deflect until the contact end 42 contacts the buttress 50. This contact both prevents the handle 40 from moving any further upwardly and nullifies any further shaft 30 flex. As the seat 100 moves upward and radially on its hinge the loading from the weight of the seat will begin to transfer from the device FIG. 1B to the seat hinge thereby reducing the amount of deflection in the shaft 30 and lessening to the eventual point of elimination the contact force between the buttress 50 and the shaft 30 and handle 40. The shaft 30 will be able to flex in other directions; the handle 40 design prevents user contact diminishment. When repositioning seat to horizontal or down position all actions work in reverse.

When the seat is in the vertical or up position the device FIG. 1B is up and out of the way. When the seat rests in the horizontal or down position vandals can kick the handle 40 and it will deflect unrestrained in either horizontal direction or in any downward direction. Persons who accidentally contact the handle 40 will be spared injury of any consequence due to the flexing action.

DESCRIPTION AND OPERATION

Alternative Embodiments

Figure 2:
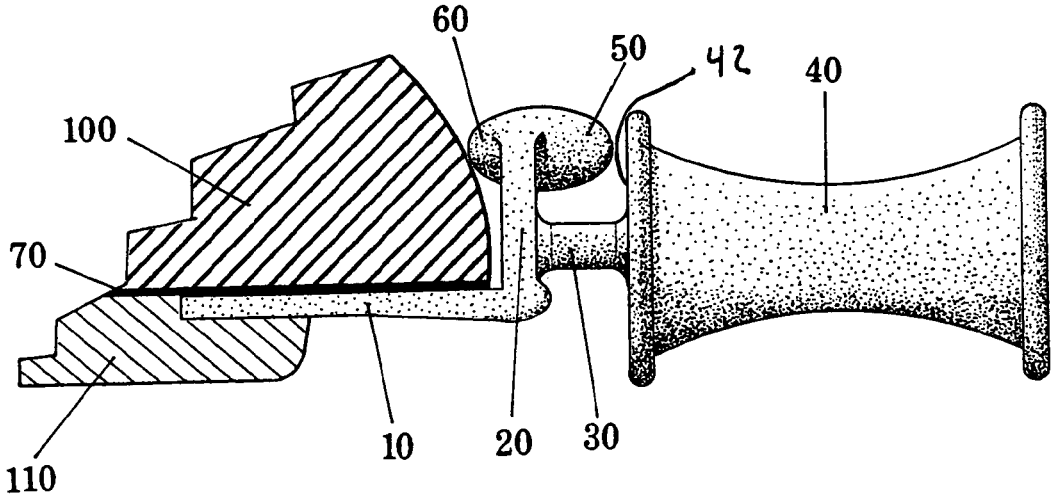
FIG. 2 shows a side view of a different embodiment

FIG. 2 shows an alteration of the buttress 50. This configuration will create no snubbing action to the shaft 30 but does annul movement from flexing of the handle 40.

Figure 3:
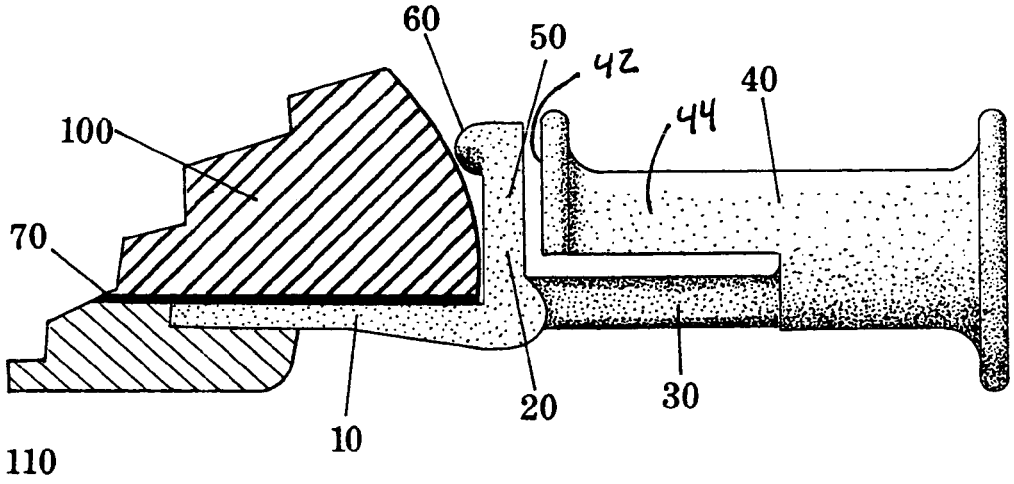
FIG. 3 shows a side view of a different embodiment

FIG. 3 displays means of elongating shaft 30 (to create more flex motion or to be able to work with a material of lower flexibility coefficient) without expanding over all dimensions. Functions same as Preferred Embodiment in that it retards movement of both the handle 40 and the shaft 30 in an upward direction due to the interaction of flange 50 and the contact end 42 of the extension 44 of handle 40.

Figure 4:
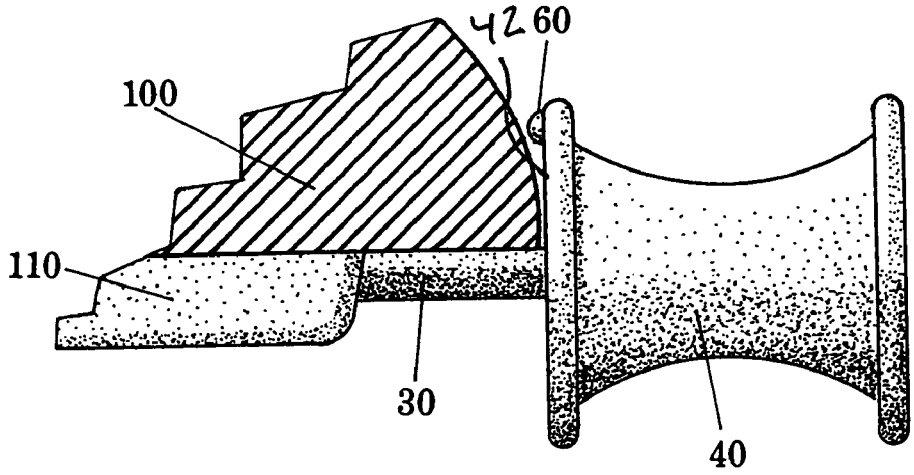
FIG. 4 shows a side view of a different embodiment

FIG. 4 depicts a variation wherein a shaft 30 and handle 40 and a seat bumper pad 110 are molded as one piece and fitted to the bottom of a toilet seat 100 at the point of manufacture. This eliminates the need for a mounting surface 10 or a flange 20. It produces the double buffering action of restricting both the handle 40 and the shaft 30. Shaft 30/handle 40 motion can occur in either direction horizontally or in any direction downwardly. Upward motion is limited by the contact end 42 engaging the side wall of the toilet seat. The shaft 30 as depicted could be either cylindrical as in other embodiments or hemi-cylindrical as depicted to fit flushly to underside of toilet seat 100.

Figure 5:
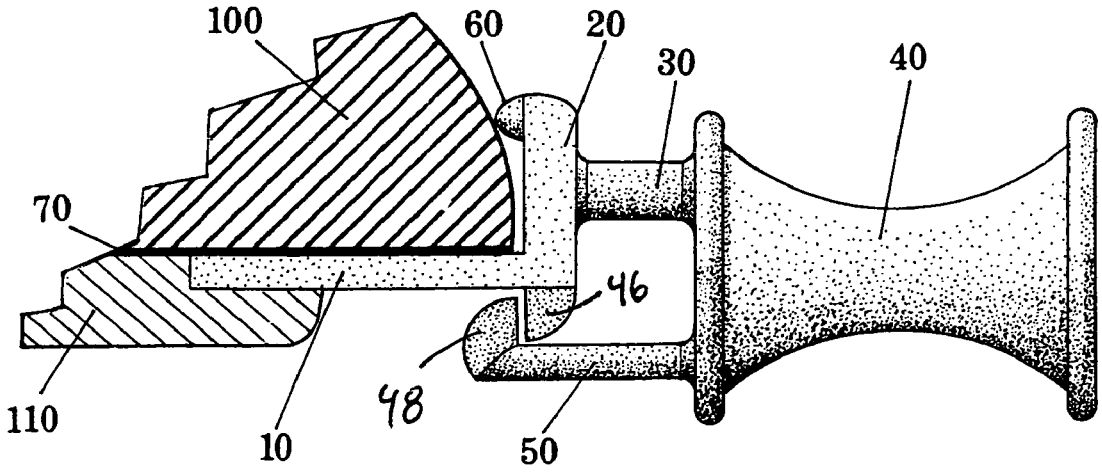
FIG. 5 shows a side view of a different embodiment

FIG. 5 embodiment shows the buttress 50 as a catch shaft extending from the handle 40 to a position under the flange 20. From under the flange 20 extends a lip 46 configured to act as a cleat. At the end of the buttress 50 catch shaft is a catch 48 opposal to the lip 46. When an upward force is applied to the handle 40 the catch 48 will engage lip 46 which will annul any further upward movement of the handle 40. As in other designs lateral or downward motion is mechanically unimpeded. This embodiment produces restraint of movement via a pulling action rather than through compression.

CONCLUSION, RAMIFICATIONS AND SCOPE OF THE INVENTION

In "Background of the Invention" 6 criteria were declared as being requirements of an invention to perform adequately (and be marketable; if they can't be manufactured and marketed they can't be used!). No previous invention, in my estimation even remotely satisfied more than 4 criteria; many only 2 or 3. The conceptualization herein meets easily all 6 requirements.

The first criterion proposed total relief from the dreadful contact with the toilet seat or bowl rim. This was accomplished by designing a handle that both extends away from the repugnant surfaces and prevents the users grasp from slipping.

The second criterion insisted on ease of use. The unique design of the handle allows the user to merely hook one or two fingers around the handle to lift it. Gripping, grasping, lifting with your shoe are all unnecessary.

Criteria 3 and 4 proposed that the device thwart injury or damage to itself and/or the seat due to contact, accidental or intentional. As has been demonstrated in previous sections this invention allows handle deflection laterally and in any downward direction due to its ingenious design to assure that these criteria are met. Equally ingenious is the motion anullment feature which accepts force in the lifting/lowering directions.

Criteria 5 and 6 demanded that the lifting handle be easily afixed to virtually any toilet seat. With its thin mounting surface and using a double-sided foam adhesive tape this totally unique invention can easily and quickly be mounted to plastic seats, wooden seats, thick seats, thin seats, seats with bumper pads, or seats without. Even vinyl covered foam seats!

This device clearly exhibits manifest advantages over any previous invention of its kind. For once there is a complete product that can be offered to the public for use in their homes. And a product that can be used in commercial applications (schools, hospitals, public buildings of all kinds, restaurants, et al.) where the presence of such a device would be most welcome.

As this invention may be embodied in a wide range of forms without departing from the spirit or essential characteristics thereof, the depicted embodiments are therefore illustrative and not restrictive, and since the scope of the invention is defined by the claims, all alterations that fall within the metes and bounds of the claims or that form their functional as well as conjointly cooperative equivalents are therefore intended to be embraced by those claims.

I claim:

1. A toilet seat and toilet seat repositioning device comprising:

a flexible shaft extending from connection with a toilet seat, said shaft having an axis extending substantially parallel to a bottom surface of said toilet seat;

a handle extending from an end of said flexible shaft, wherein the flexibility of said flexible shaft is such that manipulation of said handle causes said flexible shaft to flex relative to said axis; and shaft limiting means for limiting the flexing of said flexible shaft in an intended direction off of said axis so that force applied to said flexible shaft to flex said flexible shaft in said intended direction is transferred to lift said toilet seat, and force applied to said flexible shaft in non-intended directions causes the deflection of said flexible shaft off said axis.

2. The toilet seat and toilet seat repositioning device of claim 1, wherein said shaft limiting means comprises:

a flange extending upwardly from an end of said flexible shaft opposite said handle, said flange extending in close proximity to a side wall of said toilet seat; and a buttress extending from said flange in a direction away from said side wall, said handle having a contact end in close proximity to said butress, wherein force applied upwardly on said handle flexes said flexible shaft upwardly and said contact end of said handle contacts said buttress and said flange contacts said side wall of said toilet seat thereby limiting the flexing of said flexible shaft and transferring the upward force to said toilet seat to lift the same.

3. The toilet seat and toilet seat repositioning device of claim 2, wherein said flange includes a protuberance extending toward said side wall, said protuberance contacting said side wall during the application of upward force on said handle.

4. The toilet seat and toilet seat repositioning device of claim 1, wherein said shaft limiting means comprises:

a flange extending upwardly from an end of said flexible shaft opposite said handle, said flange extending in close proximity to a side wall of said toilet seat; and an extension of said handle extending over said flexible shaft and ending at a contact end in close proximity to said flange, wherein force applied upwardly on said handle flexes said flexible shaft upwardly and said contact end of said handle contacts said flange, forcing said flange into said side wall of said toilet seat, thereby limiting the flexing of said flexible shaft and transferring the upward force to said toilet seat to lift the same.

5. The toilet seat and toilet seat repositioning device of claim 4, wherein said flange includes a protuberance extending toward said side wall, said protuberance contacting said side wall during the application of upward force on said handle.

6. The toilet seat and toilet seat repositioning device of claim 1, wherein said flexible shaft is secured underneath said toilet seat at an end of said flexible shaft opposite said handle, and said flexible shaft extends out from underneath said toilet to connection with said handle at a contact end of said handle, said contact end extending upwardly in close proximity to a side wall of said toilet, wherein force applied upwardly on said handle flexes said flexible shaft upwardly and said contact end of said handle contacts said side wall of said toilet seat, thereby limiting the flexing of said flexible shaft and transferring the upward force to said toilet seat to lift the same.

7. The toilet seat and toilet seat repositioning device of claim 6, wherein said flange includes a protuberance extending toward said side wall, said protuberance contacting said side wall during the application of upward force on said handle.

8. The toilet seat and toilet seat repositioning device of claim 1, further comprising:

a mounting surface secured to said bottom surface of said toilet seat;

a flange extending upwardly from said mounting surface in close proximity to said side wall of said toilet, wherein said flexible shaft extends between said flange and said handle;

a lip extending downwardly from said mounting surface;

a catch shaft extending from said handle beneath said flexible shaft, said catch shaft ending in a catch extending upwardly in registration with said lip such that force applied upwardly on said handle flexes said flexible shaft upwardly and brings said catch into contact with said lip, thereby limiting the upward flexing of said flexible shaft and transferring the upward force to said toilet seat to lift the same.

9. The toilet seat and toilet seat repositioning device of claim 1, wherein said handle extends from said flexible shaft along an axis substantially parallel to said axis of said flexible shaft and provides a contact surface that tapers from a wider diameter at the ends of said handle to a smaller diameter at the middle of said handle, such that, as said handle is manipulated and said flexible shaft flexes in said intended direction the taper of said handle maintains the contact surface of the handle in an orientation that accommodates continued manipulation in said intended direction.

10. A toilet seat and toilet seat repositioning device comprising:

a flexible shaft extending from connection with a toilet seat, said shaft having an axis extending substantially parallel to a bottom surface of said toilet seat;

a handle extending from said flexible shaft along an axis substantially parallel to said axis of said flexible shaft and providing a contact surface that tapers from a wider diameter at the ends of said handle to a smaller diameter at the middle of said handle, wherein the flexibility of said flexible shaft is such that manipulation of said handle in a direction off of its axis causes said flexible shaft to flex relative to its axis, and the taper of said handle maintains the contact surface of the handle in an orientation that accommodates continued manipulation in said direction; and shaft limiting means for limiting the flexing of said flexible shaft in an intended direction off of said axis so that force applied to said flexible shaft to flex said flexible shaft in said intended direction is transferred to said toilet seat to lift the same, and force applied to said flexible shaft in non-intended directions is transferred to flex said flexible shaft off said axis.

* * * * *